US006893177B2

(12) United States Patent
Weaver et al.

(10) Patent No.: US 6,893,177 B2
(45) Date of Patent: May 17, 2005

(54) WRITING INSTRUMENT

(76) Inventors: Jennifer Weaver, 3518 Millvale Rd., Baltimore, MD (US) 21244; William T. Geddes, 11107 Powers Ave., Cockeysville, MD (US) 21030

( * ) Notice: Subject to any disclaimer, the term of this patent is extended or adjusted under 35 U.S.C. 154(b) by 0 days.

(21) Appl. No.: 10/185,232

(22) Filed: Jun. 28, 2002

(65) Prior Publication Data

US 2004/0001736 A1 Jan. 1, 2004

(51) Int. Cl.[7] ..... A46B 5/04
(52) U.S. Cl. ..... 401/7; 401/6
(58) Field of Search ..... 401/7, 6, 8, 48; 16/430; D19/51, 41, 46, 47

(56) References Cited

U.S. PATENT DOCUMENTS

| | | | | | |
|---|---|---|---|---|---|
| 336,540 | A | * | 2/1886 | Wyttenbach | 401/7 |
| 852,514 | A | * | 5/1907 | Laube | 401/88 |
| 2,177,205 | A | * | 10/1939 | Dalmas | 401/7 |
| D341,622 | S | * | 11/1993 | Poisson | D19/51 |
| 5,391,010 | A | * | 2/1995 | Gorbunov | 401/7 |
| D395,674 | S | * | 6/1998 | Boix Gacia | D19/51 |
| 5,885,018 | A | * | 3/1999 | Sato | 401/7 |
| 6,273,626 | B1 | * | 8/2001 | Yazawa | 401/6 |

* cited by examiner

*Primary Examiner*—David J. Walczak
(74) *Attorney, Agent, or Firm*—Mishrilal Jain

(57) ABSTRACT

A unique writing instrument. Preferred is an open-ended barrel in a wishbone configuration. A method of producing the writing instrument is also described.

3 Claims, 4 Drawing Sheets

Top Side

WRITING INSTRUMENT

FIELD OF THE INVENTION

The present invention relates to a writing instrument. In particular, the. present invention relates to an article that comprises a light weight, novel and comfortable writing instrument shaped in a unique configuration that ameliorates fatigue and stress while writing. More particularly, the present invention is related to a writing instrument comprising a semi-cylindrical, concave or open barrel shaped resting platform that forks and extends to form a flexibly comfortable support means for securely holding a finger of the user operating the writing instrument, without causing cramping or fatigue to the hand or fingers of the person using said instrument, and a method of making said article.

BACKGROUND OF THE INVENTION

Currently pens and other writing instruments have a cylindrical or hexagonal barrel of uniform shape along the length of the barrel. Conventional writing instruments offer no designated area on which the fingers of the user may rest. In addition, the conventional writing instruments, being of consistent shape, affords no choice or variety in finger placement and forces the user to conform to the given fixed shape of the writing instrument. Furthermore, conventional writing instruments are not of particular help to a user with deformities, prosthetics or other physically limiting conditions or to children during their writing development stage. A few designs have attempted to vary the barrel configuration to allow for finger placement in certain designated areas along the writing instrument. Some designs provide for rings into which a user's finger may be inserted. However, such designs do not accommodate a user with specific needs or who may have deformities or who may be using prosthetic devices. In addition, the available designs limit the range of motion and the placement of the fingers upon the instrument while writing because the user's finger is restricted to within the restricted space or ring. The present invention offers a novel design and approach to alleviating such problems, which the available writing instruments do not offer.

Accordingly, there is a need for providing a writing instrument that accommodates various hand and finger shapes and sizes and facilitates use by those with prosthetic devices, deformities or other physical limitations. There is an additional need to provide a writing instrument that allows for a greater range of flexibility and motion while writing to accommodate a user's particular writing style and needs and more naturally fit the contour of the user's hand and fingers so as to provide easy grip to the writing instrument without causing fatigue, discomfort or stress to the hand or finger. In addition, there is a need to provide a writing instrument with a novel design, that is pleasing, comfortable, lightweight and easy to manufacture.

SUMMARY OF THE INVENTION

Accordingly, it is an advantage of the present invention to meet these and other needs through preparing an instrument that provides an open-ended barrel with a designated cavity into which the user's finger may comfortably fit.

It is another object of the invention to provide a writing instrument that accommodates users with large fingers or deformities that may render other writing instruments unusable.

It is still another object of the invention to provide a writing instrument that encourages and facilitates writing development skills in children.

It is yet another object of the invention to provide a writing instrument that allows for a flexible range of motion to accommodate an individual user's writing style and needs.

It is still another object of the invention to provide a writing instrument that is pleasing and comfortable to hold and that conforms to an individual user's hand or fingers while writing.

Another advantage of the device of the present invention is that it obviates cramping, strain, fatigue or discomfort to a user, which would otherwise occur after a prolonged usage of the writing instrument without the benefit of the device of the present invention.

It is yet another object of the invention to provide a writing instrument that is simple in construction, low in cost, lightweight and easy to manufacture.

To achieve the stated and other advantages of the present invention, as embodied and described below, the invention includes a writing instrument, comprising an open-ended barrel with a cavity, space and/or platform for the user's finger to rest, providing comfortable use of the article without causing distress or fatigue to the hand or fingers of a user, particularly during prolonged usage, said barrel being with or without a texture and of various adjustable or adaptable designs, shapes, sizes and configurations.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

References will now be made in detail to embodiments of the present invention, examples of which are illustrative in the accompanying drawings.

DETAILED DESCRIPTION OF THE INVENTION

The invention includes a writing instrument so as to provide an open-ended barrel that is lightweight and comfortable to use and accommodates a user with large fingers, deformities, prosthetics and the like. In addition, the ergonomically pleasing design allows for prolonged use of the instrument without causing stress, cramping, strain, fatigue or discomfort to the user, particularly upon prolonged usage. The device of the present invention comprises a semi-cylindrical, concave or open barrel shaped resting platform that forks and extends to form a flexibly comfortable support means for securely holding a finger of the user operating the writing instrument, without causing cramping or fatigue to the hand or fingers of the person using said instrument, and a method of making said device.

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art. The materials, methods and examples are only exemplary and not limiting.

Figure 3:
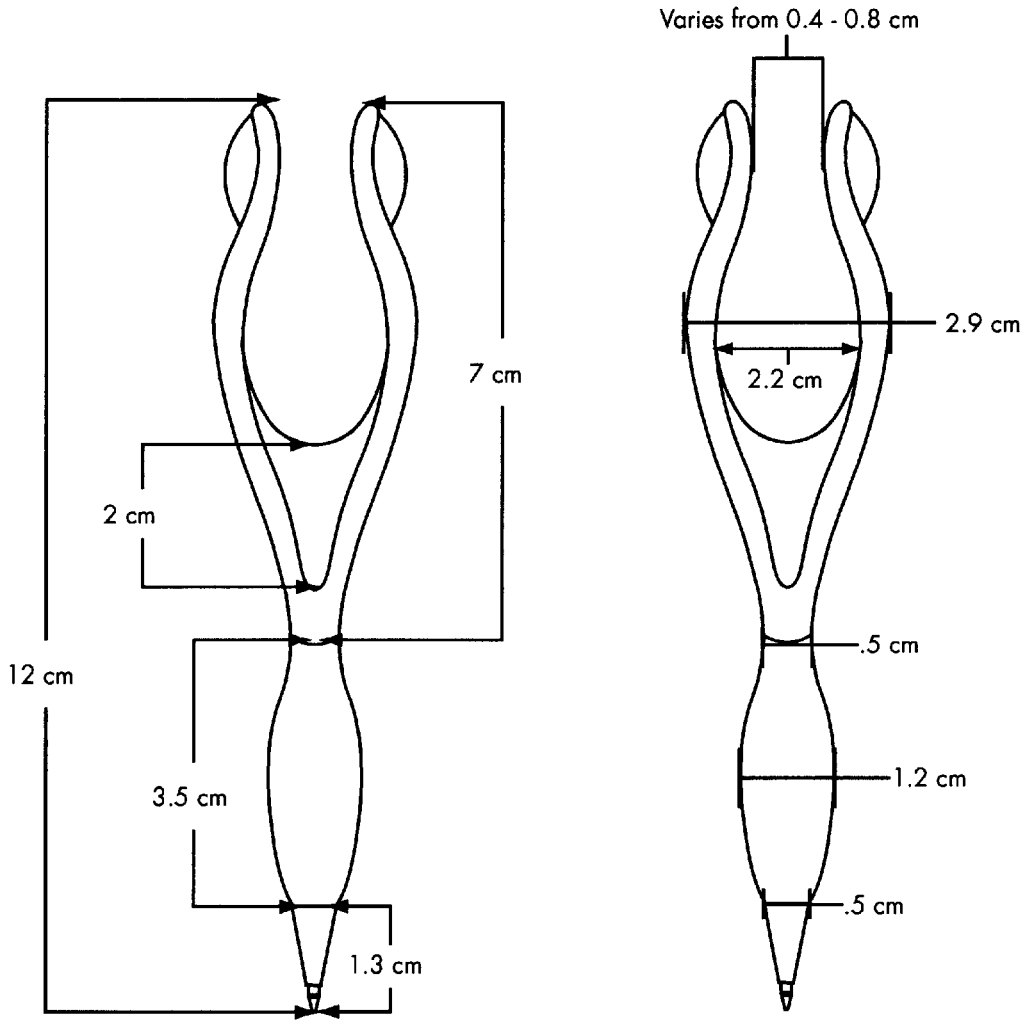
FIG. 3 depicts the top view of the invention and sets forth the approximate dimensions of various aspects of the invention.

The term "open-ended" as used herein refers to the end of the barrel of the writing instrument which represents the opening which may vary from approximately 0.4 cm to about 0.8 cm as shown on FIG. 3 and which provides a means by which a user's finger is inserted into the opening to operate the instrument.

Of course, a writing instrument includes a pen, a pencil, and the like.

Figure 1:
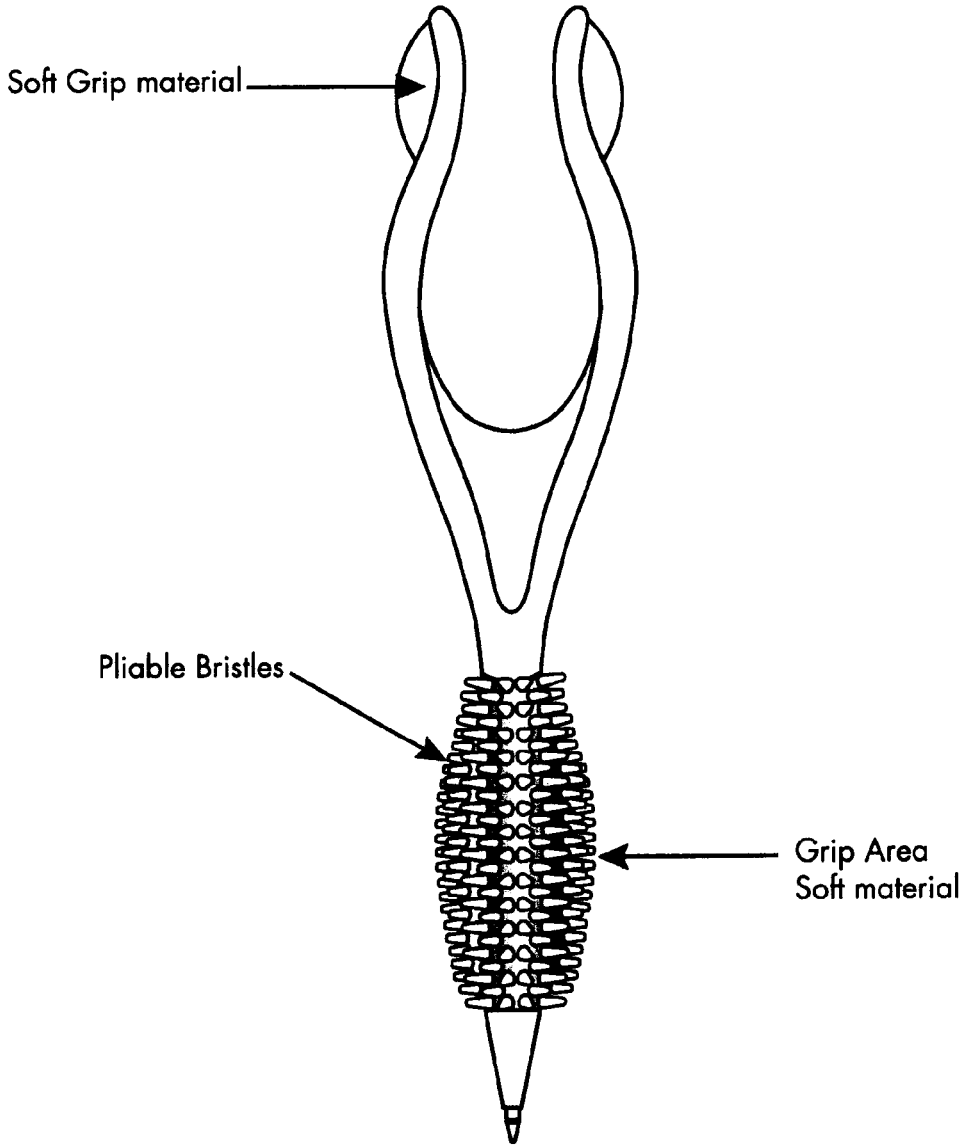
FIG. 1 exemplifies the shape of the invention from the top view and illustrates grip areas and surfaces.

FIG. 1 illustrates the top view of the invention. The invention contains a conventional ball point pen with an ink refill. Immediately next to the ball point and nib is a soft grip which provides a cushioned area at which the user's finger tips rest during the pen operation. The soft grip may be textured or formed of pliable bristles. At the end of the soft grip, the instrument takes on the shape of a flexible wishbone. From the area immediately adjacent to the grip, the instrument forks into two flexible but sturdy arms in a wishbone configuration. The user inserts the finger between the two arms and rests the finger on the concave or semi-cylindrical barrel shaped platform holding the pen by finger tip on the soft or textured grip as demonstrated in FIG. 2. The forked arms curve toward the user's finger nearly encircling the user's finger to allow secure grasp of the writing instrument.

Figure 2:
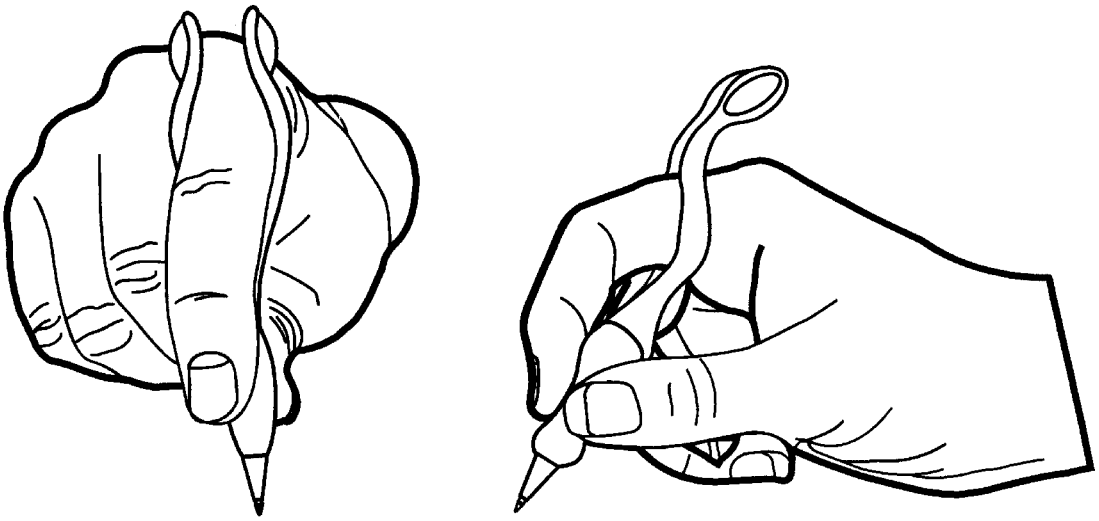
FIG. 2 demonstrates how the invention can be handled by the user.

FIG. 2 demonstrates a method by which the grip would most likely be handled by a user and placed on a writing instrument.

FIG. 3 depicts the approximate dimensions of the invention.

Figure 4:
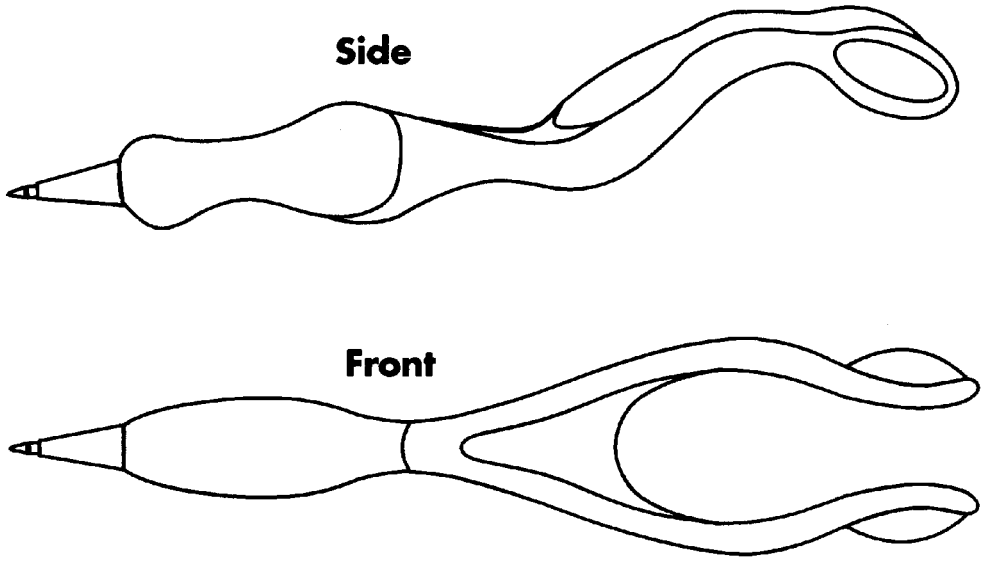
FIG. 4 shows the top and side view of the invention.

FIG. 4 exemplifies an embodiment and illustrative shape of the invention from a top and side view. The side view illustrates the stepped contour of the wishbone shaped part of the barrel.

In a preferred embodiment of the invention, the device comprises hollow portion which encompasses an ink cartridge and ball point nib, surrounded by a soft grip, with a wishbone shaped structure into which the user's finger may rest during writing.

In another embodiment of the invention, the article comprises a wishbone shaped barrel made of hard plastic which forms a step configuration to surround the user's finger. At the end of the arms of the wishbone shape, the soft grip material is applied. The arms of the wishbone shape are pliable and will vary conforming to the shape and size of the user's finger.

A method of making a device attachable to an article, comprises the following essential steps:

(i) developing an injection mold for component parts including writing instrument body, grip and soft material, nib and cone;

(ii) injection-molding various parts identified in step (i) using colored plastic to produce a single color for the writing instrument body;

(iii) verifying that injection-molding of step (ii) produced acceptable molded pieces;

(iv) electroplating the nib;

(v) verifying quality of electroplating;

(vi) screenprinting logo and producer information on the instrument;

(vii) verifying quality of screenprinting;

(viii) assembling component parts to produce the desired article; and (ix) checking quality of assembled article and packaging for shipment.

Of course, having learnt the teachings of the present invention, one skilled in the art may vary the manufacturing process in different ways to meet the objectives of the present invention.

Example embodiments of the present invention have now been described in accordance with the above advantages. It will be appreciated that these examples are merely illustrative of the invention and not limitations thereof. Many variations and modifications will be apparent to those skilled in the art and all such modifications and variations are included within the purview and scope of the appended claims.

What is claimed is:

1. An article, comprising a writing instrument including a soft grip that provides a cushioned area formed of pliable bristles at which an user's finger tips rest during the operation of the writing instrument, and having a concave resting platform that forks and extends to form an opening that ranges from about 0.4 cm to about 0.8 cm to thereby provide a comfortable support means for securely and comfortably resting and holding a finger of a person operating the writing instrument, without causing cramping, fatigue, stress or discomfort to the hand or fingers of the person using said instrument.

2. The article of claim 1, being useable by persons using prosthetic devices or having finger deformities.

3. The article of claim 1 being suitable for facilitating writing skill development in children during their writing development stage.

* * * * *